United States Patent [19]

Smith

[11] Patent Number: 4,639,320

[45] Date of Patent: Jan. 27, 1987

[54] METHOD FOR EXTRACTING WATER FROM SOLID FINES OR THE LIKE

[75] Inventor: Lloyd B. Smith, Bristol, Tenn.

[73] Assignee: United Coal Company, Bristol, Va.

[21] Appl. No.: 831,056

[22] Filed: Feb. 19, 1986

Related U.S. Application Data

[63] Continuation-in-part of Ser. No. 720,554, Apr. 5, 1985, abandoned, which is a continuation-in-part of Ser. No. 436,735, Oct. 26, 1982, abandoned.

[51] Int. Cl.[4] ..... B04B 1/06

[52] U.S. Cl. ..... 210/739; 34/8; 210/781

[58] Field of Search ..... 34/8, 58; 210/739, 781, 210/787, 144, 297, 360.1, 360.2, 363, 364, 366, 368, 372, 376, 378, 379, 380.3, 382, 512.1; 494/36, 82, 83, 84

[56] References Cited

U.S. PATENT DOCUMENTS

| | | | |
|---|---|---|---|
| 1,600,249 | 9/1926 | Sando | 210/144 |
| 1,827,648 | 10/1931 | Green | 57/76 |
| 1,965,840 | 7/1934 | Jones | 210/139 |
| 2,008,037 | 7/1935 | Quantin | 57/76 |
| 2,138,476 | 11/1938 | Jones | 210/768 |
| 2,155,919 | 4/1939 | Wooler et al. | 308/184 |
| 2,271,493 | 1/1942 | Brewer | 210/100 |
| 2,598,726 | 6/1952 | Stempel | 101/217 |
| 2,779,434 | 1/1957 | Smith | 55/271 |
| 2,783,100 | 2/1957 | Steeneck | 308/15 |
| 2,933,354 | 4/1960 | Primeau | 308/184 |
| 3,097,167 | 7/1963 | Beyerle | 494/15 |
| 3,136,721 | 6/1964 | Gooch | 210/376 |
| 3,228,596 | 1/1966 | Reed | 494/82 |
| 3,248,046 | 4/1966 | Feltman | 494/16 |
| 3,255,959 | 6/1966 | Smith | 210/213 |
| 3,275,152 | 9/1966 | Searle | 210/364 |
| 3,282,498 | 11/1966 | Smith | 403/52 |
| 3,319,880 | 5/1967 | Pause | 494/36 |
| 3,321,941 | 5/1967 | Ellis | 68/24 |
| 3,338,417 | 8/1967 | Heckmann et al. | 210/380.3 |
| 3,483,601 | 12/1969 | Van Riel | 210/372 |
| 3,494,327 | 2/1970 | Pearson | 494/36 |
| 3,606,143 | 9/1971 | Stallmann | 494/82 |
| 3,608,395 | 9/1971 | Brandt | 74/572 |
| 3,608,732 | 9/1971 | Steprath | 210/364 |
| 3,718,220 | 2/1973 | Titus | 210/374 |
| 3,731,394 | 5/1973 | Onishi | 34/58 |
| 3,797,737 | 3/1974 | Kadotani et al. | 494/81 |
| 3,913,828 | 10/1975 | Roy et al. | 494/81 |
| 3,946,940 | 3/1976 | Tadokora | 494/36 |
| 3,983,035 | 9/1976 | Arkeveld et al. | 210/144 |
| 3,993,243 | 11/1976 | Dietzel et al. | 494/36 |
| 4,069,967 | 1/1978 | Crosby et al. | 494/82 |
| 4,224,165 | 9/1980 | Laven et al. | 210/363 |
| 4,236,426 | 12/1980 | Meinke et al. | 74/574 |
| 4,257,495 | 3/1981 | de Brie Perry | 308/26 |
| 4,269,711 | 5/1981 | Gerteis | 210/380.3 |
| 4,362,619 | 12/1982 | Bange | 210/360.1 |
| 4,386,122 | 5/1983 | Birdsall | 210/360.1 |
| 4,412,831 | 11/1983 | Avery et al. | 494/82 |
| 4,449,966 | 5/1984 | Piramoon | 494/82 |
| 4,518,621 | 5/1985 | Alexander | 210/781 |

FOREIGN PATENT DOCUMENTS

| | | | |
|---|---|---|---|
| 2093719 | 9/1982 | United Kingdom | 494/36 |

*Primary Examiner*—Peter Hruskoci

*Attorney, Agent, or Firm*—Jennings, Carter, Thompson & Veal

[57] ABSTRACT

A method for centrifugally drying solid fines and the like limits the freedom of movement of a high speed batch-type centrifuge to radial excursions and varies the natural radial vibration of the system in accordance with the rotational frequency of the system to prevent operating the centrifuge at resonance conditions. Use of the method allows for high speed loading, drying and removal of the fines in a centrifuge.

4 Claims, 5 Drawing Figures

3
22
23
26
17
36
37
38
33
34
31
28
27
18
56
16
59
54
62
61
57
13
58
14

METHOD FOR EXTRACTING WATER FROM SOLID FINES OR THE LIKE

This is a continuation-in-part of application Ser. No. 720,554, filed Apr. 5, 1985 now abandoned, which is a continuation-in-part of U.S. patent application Ser. No. 436,735, filed Oct. 26, 1982 now abandoned.

BACKGROUND OF THE INVENTION

The present invention relates to the field of centrifugal removal of fluids from solid fines such as ore slurries, industrial wastes, coal, and the like. More particularly the present invention relates to an improved method of operating batch-type centrifugal fine solids drying systems. In even greater particularity the present invention may be described as an improved method of operating batch-type centrifugal fine-solid drying systems by stabilizing a gimbal-mounted shaft and bowl combination under high speed cut-out and loading conditions, with said drying system utilizing very high speed rotation to achieve a surface moisture content of less than ten percent.

In the art to which this invention relates, the problems of operating batch-type centrifuges with their less than perfectly balanced loads of fine particulate at the very high speeds necessary for drying to extremely low moisture levels have not been solved. That is, in prior methods the constructions used would be unsafe or too expensive for use at the high production rates and at the very high speeds necessary to dry fine particulate to very low moisture levels for practical costs. In addition, the prior art has not addressed the problems of cutting out the fine dried particulate at higher speeds on a dynamic suspension system capable of safe and economical operation.

By way of example, the coal industry has an urgent need for an improved means for drying coal fines smaller than 100 mesh size in economical manner with minimal pollution and safety problems. Prior commercial centrifuges for this service fall into three principal catagories:

(1) Solid bowl decanters with screws for advancing the solids through the bowls;

(2) Screen bowl centrifuges with screws for advancing the solids through the bowls; and (3) Batch centrifuges, similar to that shown in U.S. Pat. No. 2,271,493, which receive moist particulate at low speeds, raise the bowl speed to a higher speed for drying, and then slow down again for removal of the dried solids. Some of the prior batch-type centrifuges have crude resilient suspension means, U.S. Pat. No. 3,275,152 for example, but they have been unsuitable for the very high speeds and high production rates needed to economically dry very fine coal.

None of these three types of existing centrifuges can be used to obtain a high enough gravity level to dry sub 100 mesh size coal to below twenty to thirty percent surface moisture. Furthermore, the screen bowl centrifuges lose most of the coal of less than 325 mesh size through the screen. Consequently coal cleaning plant operators, who want their fine coal dried to below twenty percent moisture, are left with the choice of using thermal dryers or press-type dryers. Both of these are expensive. Press-type dryers cannot dry very fine coal below fifteen to twenty percent surface moisture. Thermal dryers, although unsafe and potentially environmentally pollutant, can dry fine coal below ten percent surface moisture; however they cannot handle very fine coal unless it is premixed with coarse coal, and the dried coal fines are dusty and will blow away during transportation.

SUMMARY OF THE INVENTION

It is an object of the present invention to provide a method of centrifuge operation which will dry moist fine particulate to lower moisture levels than has been possible with prior art large scale centrifuges.

Another object of the invention is to operate a centrifuge to dry fine moist particulate without causing pollution problems, safety hazards or significant losses of particulate in the fluid extracted from the particulate.

Another object of the invention is to provide a method of operating a batch-type centrifuge capable of handling unbalanced loads at very high drying speeds.

Yet another object of the invention is to provide a method of operating a batch-type centrifuge capable of cutting out dried solids at rotational outer surface speeds equivalent to at least forty-five hundred feet per minute.

Still another object of the invention is to provide a method of operating a high production batch-type centrifuge which can be filled at rotational outer surface speeds in excess of 11,000 feet per minute.

Yet another object of the invention is to provide a method of operating a batch-type centrifuge smoothly, safely, and economically with unbalanced loads by changing either the natural radial frequency of the system or the radial energy absorption from the rotating elements.

My invention accomplishes these objects by taking advantage of the natural physical tendencies of rotating elastic bodies. An elastic body, to wit, the bowl and shaft of a centrifuge, will vibrate freely at one or more of its natural frequencies if its equilibrium is momentarily disturbed by an external force. If the external force is applied repeatedly the elastic body will vibrate at the frequency of the external excitation. A rotating elastic system will have critical operating speeds at which objectionable vibrations are likely to occur. These speeds correspond to the various natural frequencies of the system. Since imbalances will always exist in the system, there will always be an excitation force with a frequency corresponding to the operating speed. When one of the system's natural frequencies coincides with the rotational frequency of the system, resonance results with maximum vibration of the system. The natural frequencies and consequently the critical speeds are not merely a property of the rotating shaft alone, rather they are also affected by the bearings, the supports, and the foundation; thus variation in these contributing factors will result in a variation of the natural frequencies and the critical speed.

My invention varies the resiliency of the support element to alter the natural radial frequency of the system. A batch-type centrifuge by design rotates at a variable speed which ranges from a relatively low cut-out speed for removal of the dried fines, a moderately higher loading speed and a very high drying speed. Consequently, the rotational speed of the centrifuge will transition through a critical speed or be required to operate for a time at a critical speed corresponding to the natural radial frequency. By varying the resiliency of the supports, I am able to shift the natural radial frequency so that the transition across the critical speed is almost instantaneous or I can raise the radial natural frequency so that the centrifuge may operate for a period of time, such as at cut-out, at a speed corresponding to the unshifted natural radial frequency.

The operating speed is not the only factor contributing to the amplitude of the vibration at resonance. Another very important factor is the damping of the system. Damping, however, is both friend and foe to a system which must operate over a wide range of speeds. At resonance, it is desirable for the actual damping to approach the critical damping of the system, thereby taking energy from the shaft and decreasing the amplitude of the vibration of the system. At the much higher drying speeds, it is desirable for actual damping to be minimal in order to efficiently utilize the energy of the system in rotating the shaft and bowl. Therefore, in my invention I vary the rate at which energy is absorbed in a damper to stabilize the bowl against excessive radial excursions during cut-out at speeds near resonance, and to allow the system to vibrate freely at the higher drying speeds.

My invention also utilizes an overhung bowl; therefore, in order to accurately control the radial vibration of the system there must be a means of maintaining the vertex of the system within a well defined locus. This is accomplished by a gimble-like mounting system at the end of the shaft opposite the bowl attachment in the locus of the vertex of precession of the system. This gimbal-like mounting and the utilization of a drive means imputting rotational force proximal the vertex minimizes the radial vibration and the external excitation to the rotating elements and isolates the support structure from radial vibration transmitted at the vertex of the system.

Briefly then my invention comprises the steps of introducing wet particulate matter into a batch-type centrifuge which is rotating at a given speed; accelerating the centrifuge to a selected drying speed; decelerating the centrifuge; removing the dried particulate from the centrifuge at a selected cut-out speed; and controlling the resiliency of the suspension such that the natural radial frequency of the centrifuge is varied in accordance with the rotating speed of the centrifuge, whereby transition of the critical speeds occur only during acceleration and deceleration and are of brief duration.

DESCRIPTION OF THE DRAWINGS

Further features and advantages of my invention will become apparent from a study of the detailed description of the preferred embodiment in conjunction with the appended drawings which form a portion of this application and show apparatus that may be employed to carry out my improved method, wherein.

DESCRIPTION OF A PREFERRED EMBODIMENT

Figure 1:
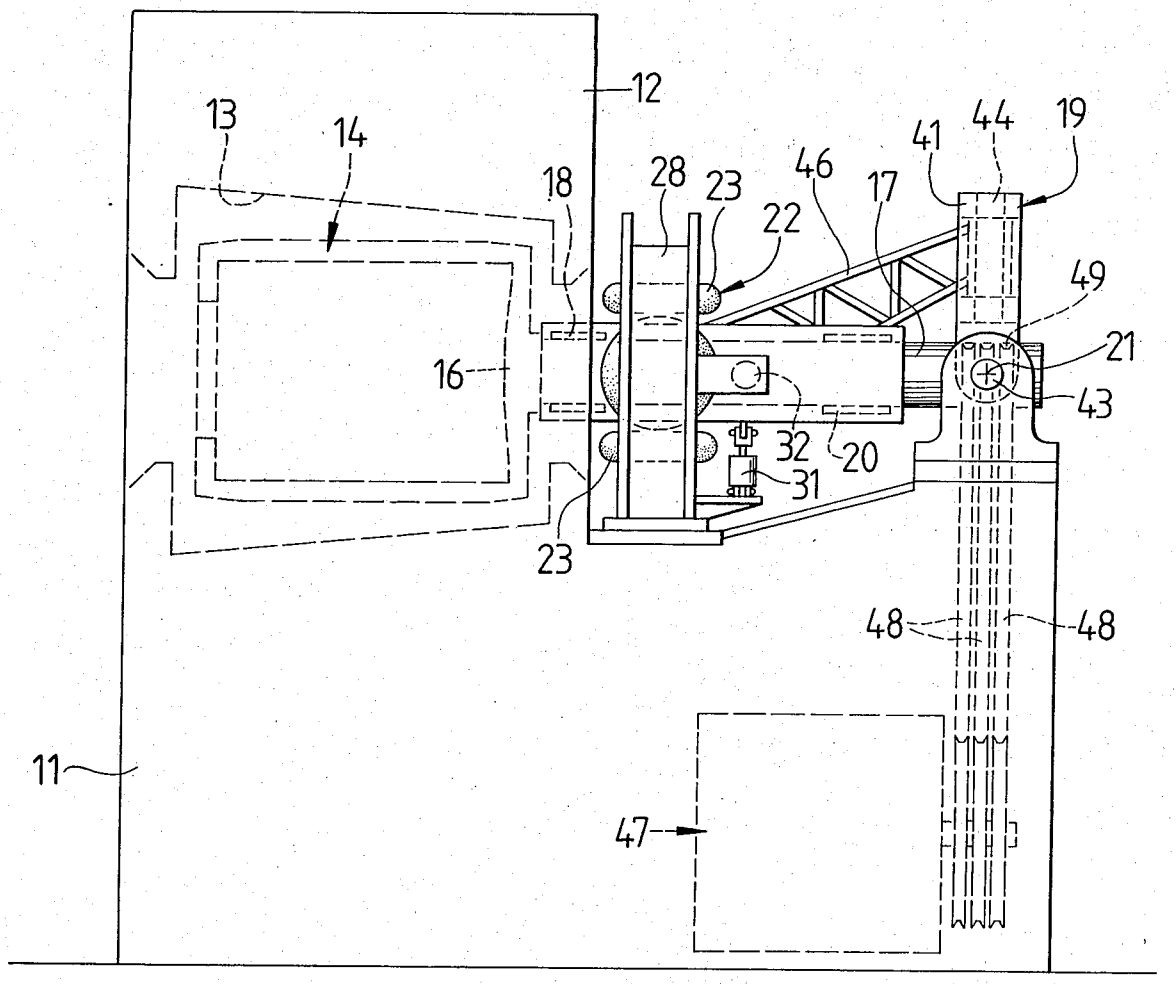
FIG. 1 is a side elevational view showing an improved centrifuge which utilizes my method.

Referring to FIG. 1, the centrifuge which employs my method utilizes a base frame member 11 including an upper housing 12 which carries an envelope 13 therewithin which incases a bowl 14. The envelope 13 is used to confine and remove fluids extracted from the fines within the bowl 14 as is well known in the art. The particular structure of the bowl 14 will be discussed hereinafter. The bowl 14 has a base support 16 affixed conventionally to a rotatable shaft 17 which rotates within longitudinally extending bearings 18 and 20. The end of the shaft 17 opposite the bowl 14 is mounted for rotation on a gimbal-like system 19. The gimbal system 19 is affixed to and supports the shaft 17 whereby there is maintained a vertex of precession of the shaft 17 and bowl 14 indicated by the numeral 21. Supporting the bearings 18 intermediate the bowl 14 and the vertex 21 proximal the bowl is a resilient support structure 22 shown more fully in FIGS. 2 and 3.

The resilient support structure 22 has two principal types of components, with one being in the form of air bags 23 and the other in the form of semi-rigid supports 24. The air bags 23 and semi-rigid supports 24 are symetrically positioned about a bearing sleeve 26 containing the bearings 18 and a shaft 17 so that the structure 22 supports the bearing 18 at an area near the bowl 14. As illustrated, the semi-rigid supports 24 are placed intermediate each pair of air bags 23; however it is to be understood that the supports 24 may be integrated within the air bags 23 as long as the air bags 23 provide the sole support to the bearing sleeve 26 when they are fully inflated. The air bags are mounted to the base frame 11 by connecting members 27 extending radially inwardly from a mounting collar 28 affixed to the base frame 11. A source of compressed air, not shown, is used to individually control the inflation of each air bag 23. The semi-rigid supports 24 include rubber pads 29 on the inwardly facing ends thereof, with the pads 29 being separated from the sleeve 26 when the air bags 23 are inflated and with the lower pads 29 abutting the sleeve 26 upon deflation of the air bags 23.

Figure 2:
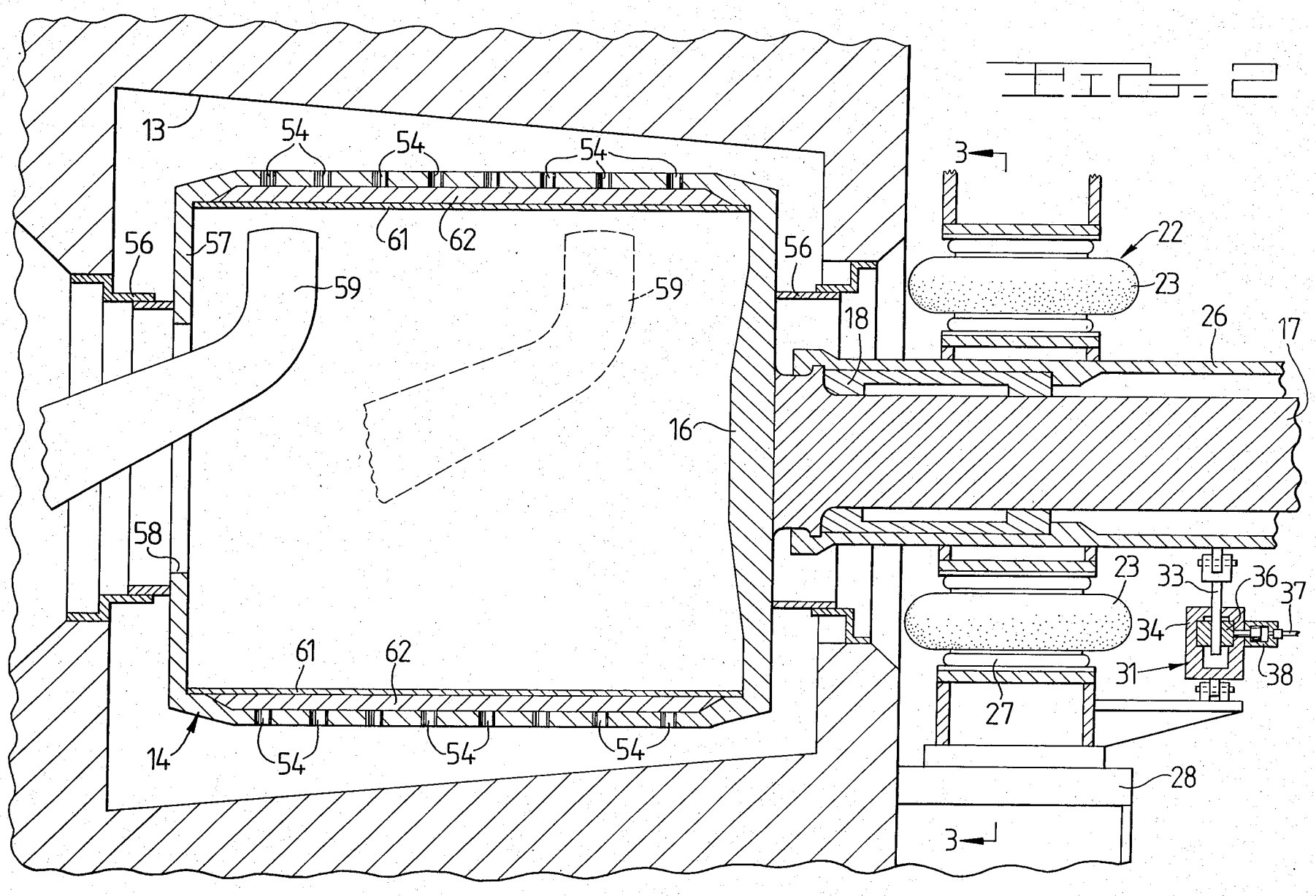
FIG. 2 is a sectional view along the axis of the shaft showing the bowl, envelope and a portion of the resilient support.
Figure 3:
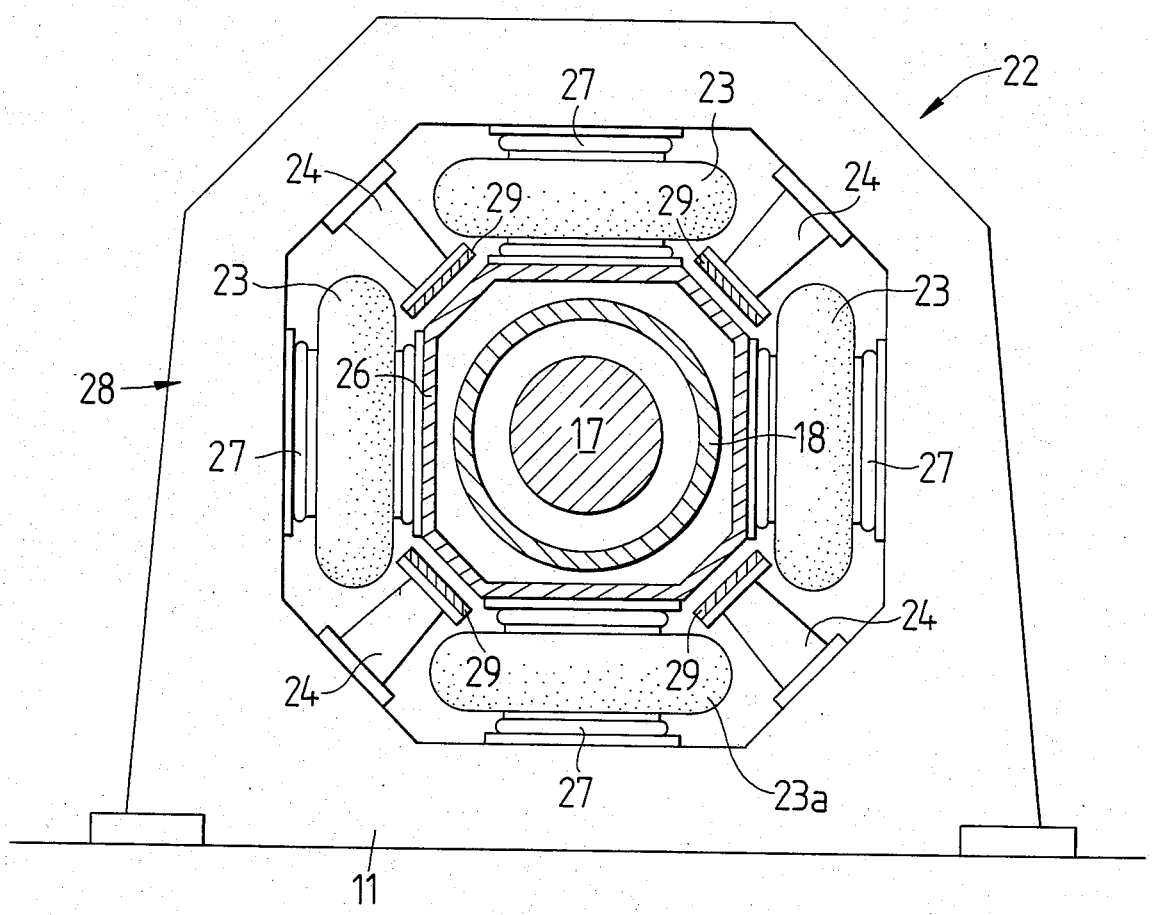
FIG. 3 is a sectional view along line 3—3 of FIG. 2.

Also shown in FIGS. 1 and 2 are a pair of radially extending shock absorbers 31 and 32 which are mounted between the sleeve 26 and the collar 28 at angularly spaced locations relative to each other. The shock absorbers 31 and 32 are used to dampen the system from excessive radial motion such as may occur at resonance. It is preferable that the energy absorption capabilities of these shock absorbers be variable so that they may stabilize the bowl 14 at cut-out speeds for the removal of the dried particulate and yet absorb minimal energy at the drying speeds; however standard industrial shock absorbers may be used. One such variable shock absorber 31 is shown in FIG. 2. The shock absorber 31 uses a flat bar 33 operatively connected to the sleeve 26 and extending into a housing 34 within which a hydraulically actuated clamp 36 is positioned to open and close about the bar 33. The pressure exerted on the bar 33 is determined by the hydraulic pressure provided to a hydraulic line 37 and cylinder 38 from an external hydraulic source, not shown.

The gimbal-like system 19 is located at the end of the shaft 17 opposite the end thereof carrying the bowl and includes a yoke 41 having pins 43 extending transversely therefrom. The pins 43 are pivotally secured to the base frame 11. A vertical pin 44 extends downwardly from the yoke 41 and supports one end of a truss 46 which is connected at its opposite end to the sleeve 26 to support the shaft 17. The shaft 17 is restrained from axial movement within the sleeve 26. This gimbal-like system 19 allows the bowl 14 and shaft 17 to be displaced vertically and horizontally within the restriction placed on the shaft 17 by the resilient support structure 22 while maintaining the vertex 21 of precession of the shaft 17 at a substantially well defined locus. A variable speed drive 47, such as a variable frequency alternating current drive, is flexibly coupled to the shaft as by at least one drive belt 48 which transfers rotational force to the shaft 17 at a belt receiving groove 49 located at the locus of the vertex 21. Alternature drive means such as variable speed direct current drives or hydraulic variable speed drives may also be used.

The use of the gimbal-like system 19 resolves the three-dimensional vibration problem into a two-dimensional problem at mounting collar 28 while isolating the base frame 11 from receiving excessive vibration which would result if a fixed bearing support were used to support the shaft 17. This allows for the use of a very high rate of rotation which places very high gravity stresses on the loaded bowl 14. Therefore the bowl construction merits discussion in that the preferable construction of bowl 14 utilizes a composite material, such as a carbon fiber reinforced epoxy, due to its combined strength, stiffness, and durability. Such composite materials have a very high strength-to-weight ratio and thus give marked advantages over other materials.

Regardless of the bowl construction materials, the bowl 14 is substantially circular in cross section as viewed along the axis thereof and has a plurality of generally outwardly directed angularly spaced apertures or discharge ports 54 which allow the extracted fluids to exit the bowl into the envelope 13 from whence the fluids are conventionally removed. In order to prevent the unintentional discharge of fluids from the envelope 13 into the bowl or along the shaft, ring seals 56 are carried between the bowl 14 and the housing 12. The bowl 14 has a radially and inwardly extending annular lip 57 of a radial dimension substantially equal to the thickness of the particulate deposited in the bowl adjacent the lip 57. This lip 57 carries one set of ring seals 56 and defines a generally unobstructed opening 58 into the bowl 14. This opening 58 provides both ingress and egress for the particulate matter which may be introduced and removed by suitable means, such as conveyors, sprayers, scrapers, blades and the like as may be convenient with the particulate matter being dried and as is indicated schematically at 59 in FIG. 2. The bowl contains a filter media 61 of an appropriate mesh size for the particulate matter and a filter media support 62 which supports the filter media 61 and allows extracted fluid to exit the bowl 14.

My method is carried out in a batch-type centrifuge having continuous rotational movement imparted thereto. That is, the wet particulate matter is introduced into the bowl 14 while the bowl 14 is rotating and is cut-out or removed from the bowl 14 while the bowl 14 is rotating. Between the time the particulate is introduced and the time the dried particles are removed the bowl is accelerated to the drying speed. A centrifuge utilizing my method operates at higher speeds than conventional batch-type centrifuges in that my minimum speed occurs at outer surface cut-out speeds of more than 4500 feet per minute my bowl outer surface speed during loading exceeds 11,000 feet per minute, and my bowl outer surface drying speed is in excess of 18,000 feet per minute.

It will be appreciated that removing the particulate from the bowl at this high cut-out speed, which for example would be above 600 rpm when a 29½ inch outside diameter bowl is used, requires that the bowl 14 be relatively stable. However, the natural radial frequency of the system when supported on the air bags 23 is about 700 to 800 cycles per minute or about 5400 to 6200 feet per minute outer surface speed when a 29½ inch outside diameter bowl is used. Thus, it can be seen that the cut-out speed will include a rotational speed corresponding to the natural radial frequency, thus resonance will result.

Figure 4A:
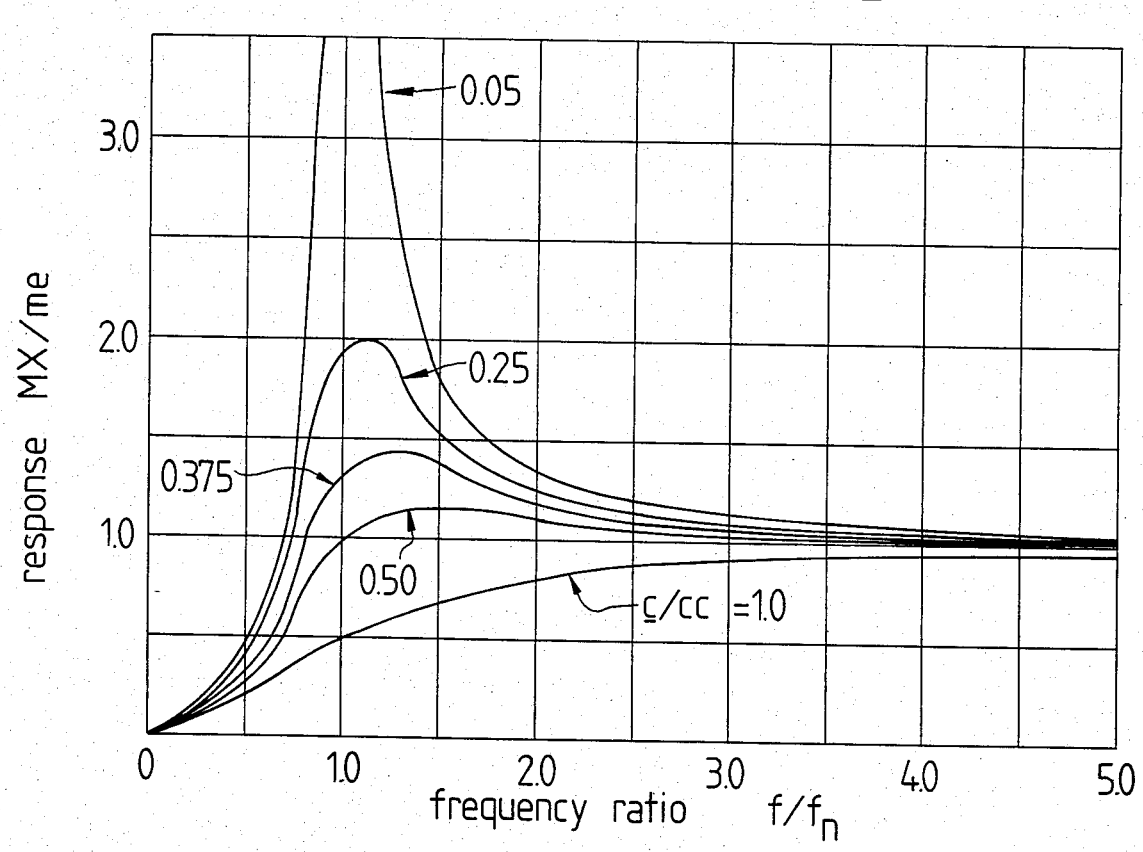
FIGS. 4A and 4B are graphic illustrations of the response amplitude and phase angle of an elastic body at various frequency ratios.
Figure 4B:
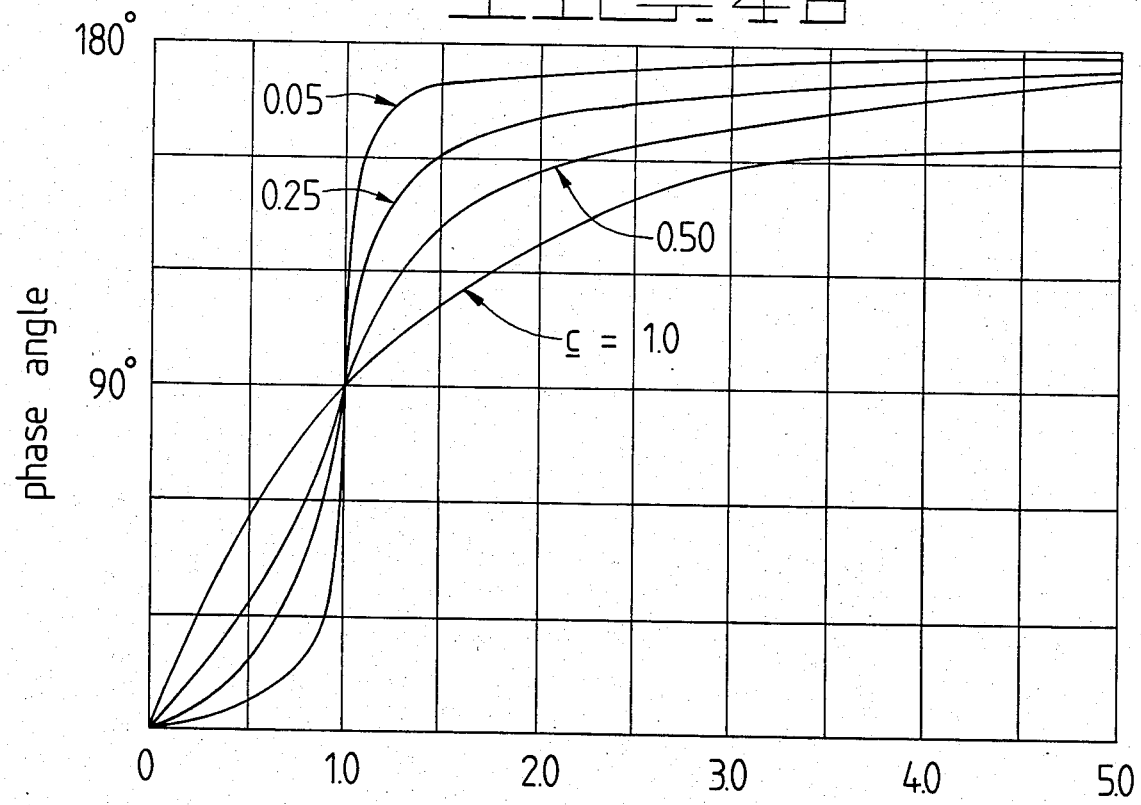

FIGS. 4A and 4B derived from *Fan Engineering*, edited by Robert Jorgenson and published by Buffalo Forge Co., illustrates the problem associated with rotating an elastic system with an unbalanced load at resonance. At drying speeds the rotational frequency f for a 29½ inch outside diameter bowl, for example, is usually 2400 rpm or greater and the shaft is supported on the air bags 23, thus the natural frequency fn is 700–800 cycles per minute, so that the frequency ratio f/fn is approximately 3.0 or greater. At this ratio the amplitude of the non-dimensional response Mx/me for the forced vibration of a system resulting from rotating imbalance is approximately 1.0. The total vibrating mass M includes the rotating mass m which has an eccentricity of e, the system amplitude is x and the phase angle or lag of the response behind the imbalance is $\phi$. The curved lines in FIGS. 4A and 4B correspond to the response and the phase angles at various ratios C between the actual damping on the system c, and the critical damping cc of the system. As will be noted at the drying speed the response will be approximately equal in amplitude to the imbalance and lag behind the imbalance by nearly 180°; thus the system will be self-balancing at the drying speed, particularly if the system has a damping ratio which is very small, such as 0.05. Therefore, at drying speeds it is desirable that the shock absorbers 31 influence the system minimally.

In contrast to this, for example at cut-out speeds for a 29½ inch outside diameter bowl of between 600 and 1000 rpm the frequency ratio f/fn with air bag support will at some point become 1.0 and the response Mx/me, with a minimal damping ratio C of 0.05, will increase well above the scale of the graph. Also the phase angle approaches 90°. The result is that the system undergoes tremendous vibration, which is totally undesirable in that the removal/loading element 59 may impact and damage the filter media 61.

In order to alleviate the problem, one of the air bags 23*a* is deflated as the rotational speed of the bowl 14 is reduced from the drying speed, and the bearing is then supported by the semi-rigid supports 24. The support structure 22 is thereby changed to a less resilient or stiffer support which increases the natural radial frequency fn of the system and increases the hysteresis losses of the system. Inasmuch as the rate of rotation of the shaft is decreasing rapidly and the change in natural radial frequency is also quite rapid the transition through the rotational speed f corresponding to the natural radial frequency fn is quite rapid and the effects of resonance are minimal. During removal of the particulate fn is above the cut-out speed; thus the frequency ratio f/fn is less than 1.0; thus the amplitude of the response Mx/me is not as severe and the phase angle is less than 90°. At this point the shock absorbers 31 interact with the shaft to increase the damping ratio C which further reduces the amplitude of the response Mx/me by taking energy out of the system. The bowl 14 is thus stabilized against excessive radial movement and the cutting-out of the dried particulate can proceed safely.

It is noteworthy to mention that the dried particulate removed is not dusty but, rather, has a consistency somewhat like table salt; therefore it is not subject to the same transportation losses due to dusting as thermally dried particulate would be.

In completing the cycle, upon completion of the cut-out operation the bowl's rotational speed is increased. For example, with a 29½ inch outside diameter bowl the speed is increased to above 1400 rpm and wet particulate is introduced. As the speed increases the air bag 23*a* is reinflated and thus the natural radial frequency fn is decreased, such that the transition across the resonance speed is again quite brief, thereby causing no problems with excessive radial excursions. The bowl is then accelerated to drying speeds usually in excess of 2400 rpm for a 29½ inch outside diameter bowl. The entire cycle takes as little as ninety seconds. It will be noted that the resilient support 22 incorporates a built-in safety feature due to its double support system. In the event of a failure of an air bag 23 the bearing sleeve 26, bearing 18, and shaft 17 will be engaged by the lower semi-rigid support 24 and the centrifuge may be safely stopped.

It is to be understood that the curves of FIGS. 4A and 4B are idealized curves for a system having one degree of freedom; however my method using a gimbal-like system 19 yields a system with only two degrees of freedom which are both radial to the bowl; thus the principles involved yield the same results, to wit: apparatus using my method, by virtue of its ability to vary the natural radial frequency of the system in a controlled manner coupled with its ability to vary the rotational speed of the system, can control the duration of the transition across a critical speed and thus minimize excessive vibration; can operate at cut-out speeds higher than prior art centrifuges; can transition from cut-out speeds to dying speeds and back more smoothly and more efficiently than prior centrifuges; can use lighter-weight materials for the shaft due to the reduction of vibratory stress; can process particulate matter more rapidly and economically; is less subject to fatigue or wear due to excessive vibration; and is simpler and cheaper to construct and operate than are prior centrifuges.

While I have shown my invention in but one form, it will be obvious to those skilled in the art that it is not so limited, but is susceptible of various changes and modifications without departing from the spirit thereof.

What I claim is:

1. A method for centrifugally removing fluid from wet particulate matter comprising the steps of:

(a) introducing said wet particulate matter into a batch-type centrifuge having a bowl with an opening at one end for receiving said wet particulate matter, a base support at the other end thereof attached to a driven shaft rotatable at variable speeds and a filter media liner proximal the inner surface of said bowl for fluid to be centrifugally extracted from said wet particulate matter;

(b) supporting said shaft on a gimbal-like system at the end thereof distal said bowl to maintain a vertex of precession of said shaft and bowl within a well defined locus and to constrain said shaft to pivotal motion about said vertex, such that the freedom of movement of said bowl and shaft is limited to directions transverse to the axis of rotation thereof;

(c) supporting said shaft proximal said bowl on supports of variable resiliency;

(d) accelerating the rotational speed of said centrifuge to a controlled drying speed to reduce the moisture content of said particulate matter to below a predetermined percentage by centrifugal extraction of the fluids;

(e) decelerating the rotational speed of said centrifuge;

(f) removing the particulate matter from the centrifuge at controlled rotational speeds of said centrifuge; and (g) controlling the natural radial frequency fn of said centrifuge by varying the resiliency of said supports of variable resiliency in accordance with the rotational speed f of said centrifuge such that the ratio f/fn becomes 1.0 only during said accelerating and decelerating steps and the interval of time during which the condition f/fn equals 1.0 is insufficient to induce excessive radial vibration in said centrifuge.

2. The method as defined in claim 1 further comprising the step of damping said centrifuge during said removing and introducing steps whereby said bowl is stabilized against excessive radial movement.

3. The method as defined in claim 1 wherein said removing step occurs at rotational outer surface speeds above 4500 feet per minute.

4. The method as defined in claim 1 wherein the rotational outer surface drying speed is in excess of 18,000 feet per minute.

* * * * *